US007621216B2

(12) United States Patent
Jacobs et al.

(10) Patent No.: US 7,621,216 B2
(45) Date of Patent: Nov. 24, 2009

(54) LABELER AND ENDLESS PRINTING BAND FOR DATE-CODING SYSTEM

(75) Inventors: Frank S. Jacobs, Centerville, OH (US); Gary E. McMullen, Springboro, OH (US)

(73) Assignee: Avery Dennison Retail Information Services LLC, Pasadena, CA (US)

( * ) Notice: Subject to any disclaimer, the term of this patent is extended or adjusted under 35 U.S.C. 154(b) by 491 days.

(21) Appl. No.: 11/471,902

(22) Filed: Jun. 21, 2006

(65) Prior Publication Data

US 2007/0298202 A1 Dec. 27, 2007

(51) Int. Cl.
*B41K 1/10* (2006.01)

(52) U.S. Cl. ..... 101/111; 101/327; 101/368; 101/372; 101/288

(58) Field of Classification Search ..... 101/111, 101/327, 368, 371, 372, 288; *B41F 13/46*
See application file for complete search history.

(56) References Cited

U.S. PATENT DOCUMENTS 862,396 A * 8/1907 Heller ..... 101/111
4,057,452 A 11/1977 Sato
4,113,544 A 9/1978 Sato
4,253,395 A 3/1981 Sato
4,321,868 A * 3/1982 Kikuchi ..... 101/111
4,846,503 A 7/1989 Strauss
5,462,909 A 10/1995 Lakes et al.
5,597,441 A 1/1997 Volk
5,910,227 A 6/1999 Mistyurik et al.
D514,154 S 1/2006 Arena et al.
2004/0205989 A1 10/2004 Michaels

FOREIGN PATENT DOCUMENTS

EP 0 041 606 12/1981
EP 0 271 096 6/1988

OTHER PUBLICATIONS

J.E. Jones; IBM Technical Disclosure Bulletin; Multicolor Easily Printable Bar Code; Aug. 1971, vol. 14 No. 3

* cited by examiner

*Primary Examiner*—Leslie J Evanisko
(74) *Attorney, Agent, or Firm*—Joseph J. Grass

(57) ABSTRACT

A printing band with human readable and printing characters is capable of printing on preprinted labels with seven color zones. The selected printing band can print the day of the week, such as Wednesday, plus obliterate all the color zones except for the color zone corresponding to the commercially accepted color for that selected day, such as Wednesday.

11 Claims, 6 Drawing Sheets

LABELER AND ENDLESS PRINTING BAND FOR DATE-CODING SYSTEM

BACKGROUND OF THE INVENTION

1. Field of the Invention

The invention relates to the field of date-coded labels, method of date coding, printing bands for date coding and hand-held labelers capable of date coding.

2. Brief Description of the Prior Art

It is known to use date coding in connection with perishable goods such as meats and produce to indicate expiration times and/or dates. The date code can be applied either to the goods or to packaging for the goods. It is known to date code by words, numbers and/or colors. When colors are used, there is a different color to designate each day of the week. One such system in use in the United States for color-coding perishable goods designates blue for Monday, yellow for Tuesday, red for Wednesday, brown for Thursday, green for Friday, orange for Saturday and black for Sunday.

The following prior art is made of record: U.S. Pat. Des. 514,154; U.S. Pat. No. 4,113,544; U.S. Pat. No. 4,846,503; U.S. Pat. No. 5,462,909; and U.S. Pat. No. 5,910,227.

It is known to date code by using an electronic thermal table-top printer to overprint adhesive backed labels which were pre-printed with colors in zones, with a different colored zone for each of seven days of the week. All of the colored zones of six days of the week are obliterated by overprinting, except for the colored zone representative of a selected day of the week. The overprinting was accomplished either with a thermal transfer ribbon on plain paper or directly on thermal coated paper. In either case, the name of the day of the week was thermally printed adjacent to the colored zone corresponding to the selected day of the week. This arrangement requires substantial investment, requires expensive ink ribbons or thermally coated paper, requires training of unskilled personnel, and requires that the user return to the thermal printer at a fixed location each time the user needs a label or labels.

SUMMARY OF THE INVENTION

An embodiment of a composite label web of the invention is of a construction enabling its use in a hand-held labeler. The composite label web is comprised of a carrier web and labels releasably adhered to the carrier web along the length thereof by pressure sensitive adhesive. The carrier web is wound into a roll and has feed apertures which enable the composite label web to be advanced from a supply roll carried by the labeler through a feed path to a printing position between a print head and a platen. A toothed member engages the feed apertures to advance the labels through the labeler to the printing position and to dispense a printed label. The labels are pre-printed with seven zones of different colors, with each color representing a different day of the week. The zones are preferably lined up along a straight line. In order to indicate a selected day of the week, all of the zones relating to the other six days of the week are obliterated leaving visible only the zone having the color relating to the selected day of the week. In the event it is desired to use such a label without any color-coding, all seven zones can be obliterated.

An embodiment of a method can be practiced with a composite label web as described above using a hand-held labeler to over-print all of the zones of the label except a zone representative of a selected day of the week, and dispensing the over-printed label.

According to a preferred embodiment, an endless printing band having an outer side with a set of printing characters disposed at longitudinally spaced locations along the outer side, is flexible and selectively positionable to register a selected printing character at a printing zone, most of the printing characters of the set having at least one printing portion and one non-printing portion, each non-printing portion of any one printing character being offset laterally with respect to all the other non-printing portions of the set.

An embodiment of a hand-held labeler can use a printing band as described above. The labeler should be capable of using a composite label web as described above and be capable of overprinting, printing, dispensing and preferably applying fully printed labels, and the labeler should have an inkable print head and a platen with which the print head cooperates at a printing zone. The labeler can be used directly at the site where the label is to be applied, instead of the user having to make trips back-and-forth to a stationary thermal printer.

BRIEF DESCRIPTION OF THE DIAGRAMMATIC DRAWINGS

Figure 1:
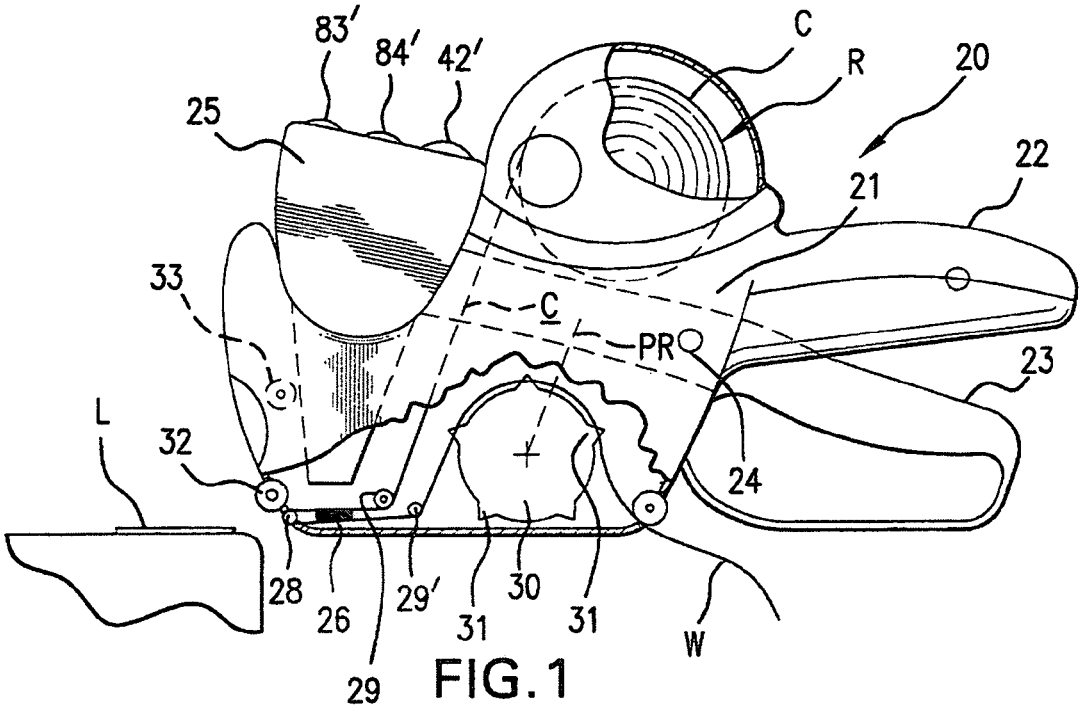
FIG. 1 is a side elevational view of a hand-held label and a printed label dispensed thereby.
Figure 8:
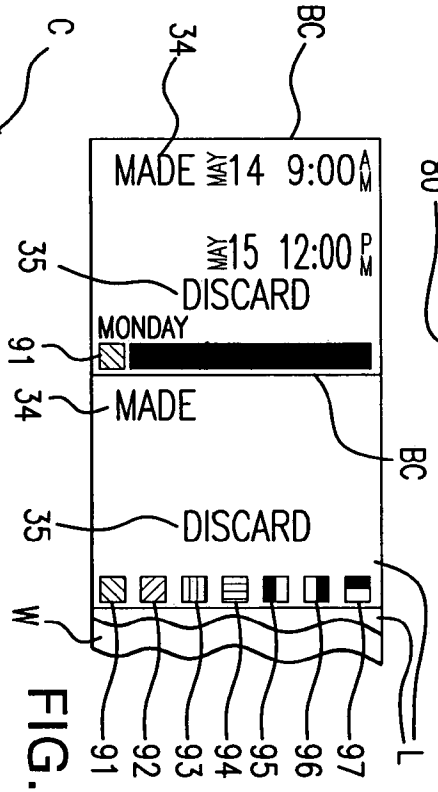
FIG. 8 is a fragmentary top plan view of a composite label web of pre-printed color-coded labels of which the endmost label has been over-printed in the labeler of FIG. 1 to indicate Monday as a day of the week.
Figure 9:
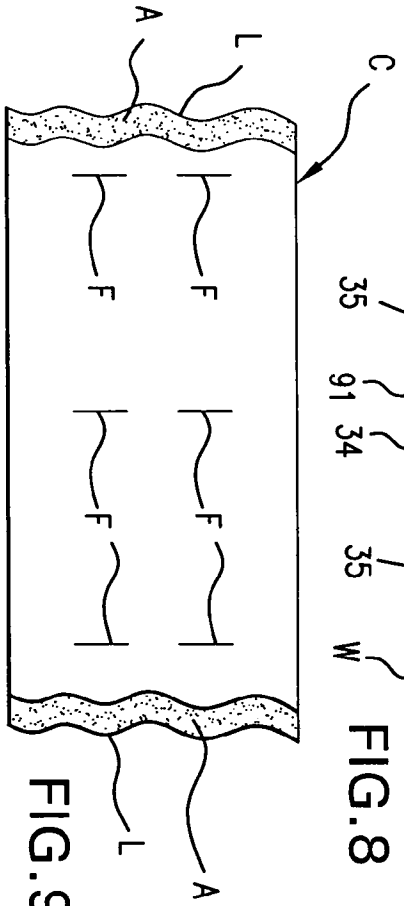
Figure 10:
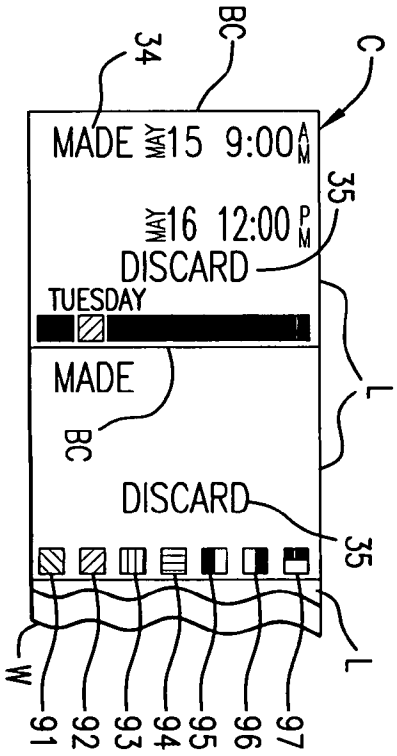
Figure 11:
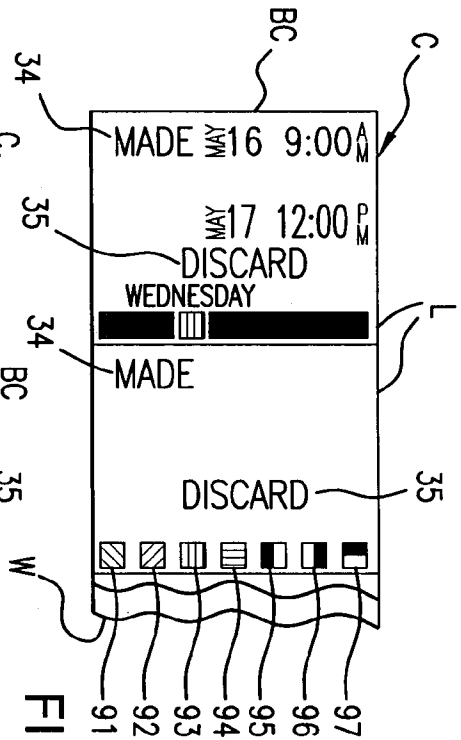
Figure 12:
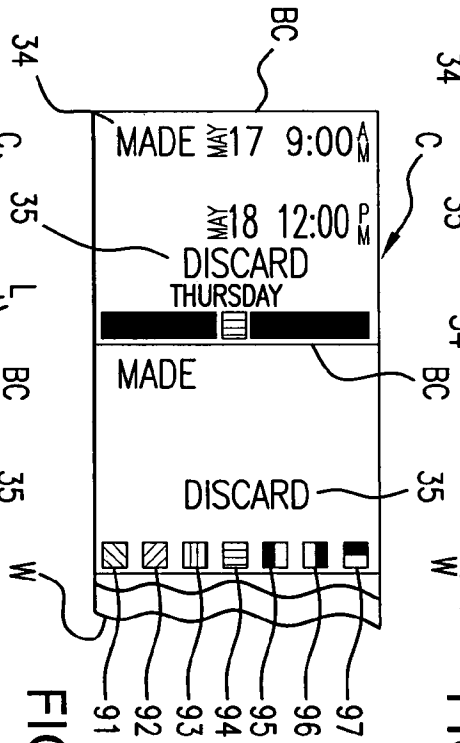
Figure 13:
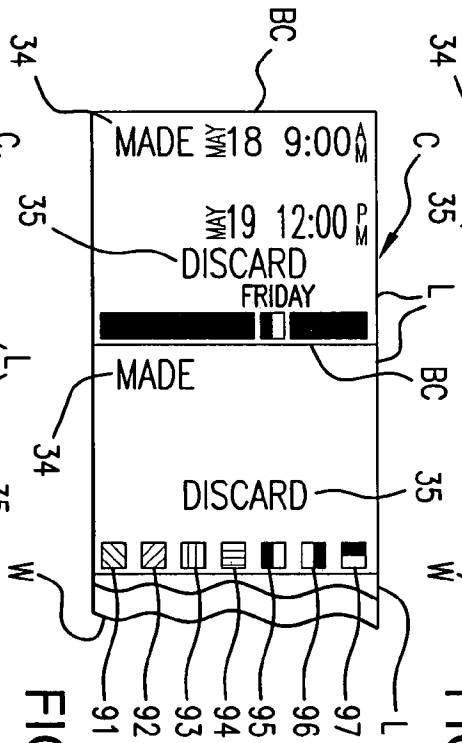
Figure 14:
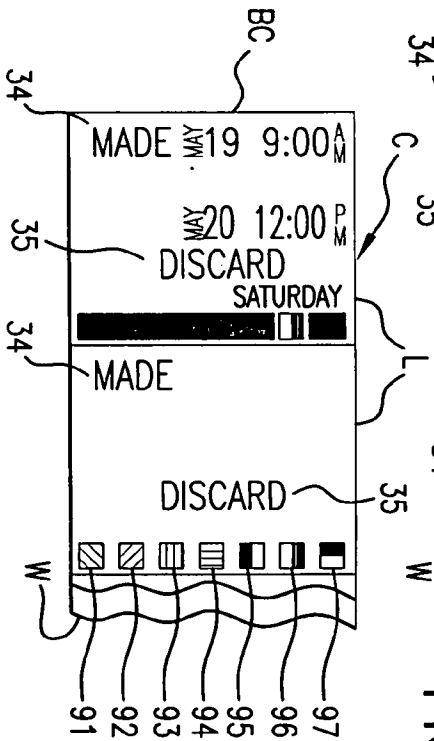
Figure 15:
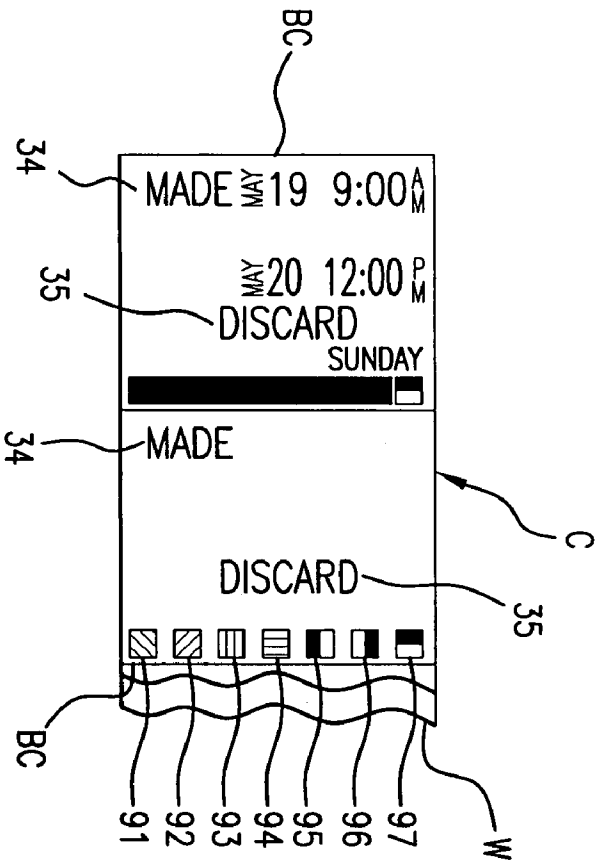
Figure 16:
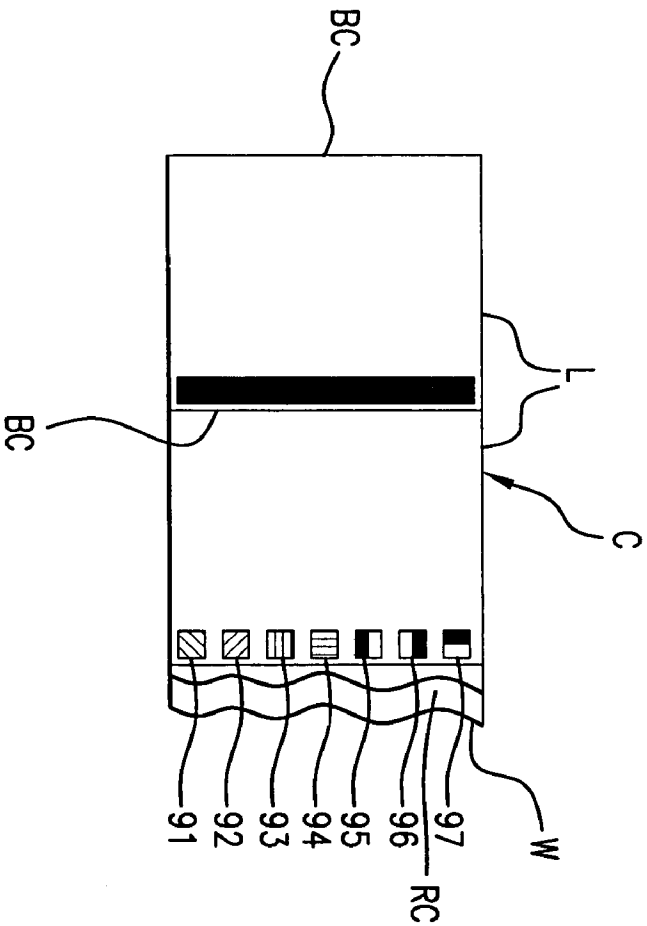

FIG. 9 of a fragmentary hollow plan view of the composite label web shown in FIGS. 1 and 8;

FIG. 10 is a fragmentary top plan view of a composite label web as shown in FIG. 8, but showing the endmost label over-printed to indicate Tuesday as a day of the week;

FIG. 11 is a fragmentary top plan view of a composite label web as shown in FIG. 8, but showing the endmost label over-printed to indicate Wednesday as a day of the week;

FIG. 12 is a fragmentary top plan view of a composite label web as shown in FIG. 8, but showing the endmost label over-printed to indicate Thursday as a day of the week;

FIG. 13 is a fragmentary top plan view of a composite label web as shown in FIG. 8, but showing the endmost label over-printed to indicate Friday as a day of the week;

FIG. 14 is a fragmentary top plan view of a composite label web as shown in FIG. 8, but showing the endmost label over-printed to indicate Saturday as a day of the week;

FIG. 15 is a fragmentary top plan view of a composite label web as shown in FIG. 8, but showing the endmost label over-printed to indicate Sunday as a day of the week; and FIG. 16 is a fragmentary top plan view of a composite label web as shown in FIG. 8, but showing the endmost label over-printed to obliterate all the days of the week.

DETAILED DESCRIPTION OF THE PREFERRED EMBODIMENTS

With reference to FIG. 1, there is shown a typical hand-held, portable labeler 20 generally as shown in U.S. Pat. Des.

514,154 except the labeler of FIG. 1 includes a three-line print head 25 capable of printing along three lines. While a labeler 20 according to U.S. Pat. Des. 514,154 is illustrated, labelers of other designs can be used, for example a three-line version of the labeler of U.S. Pat. No. 5,910,227. Three-line print heads are known in the art as shown in U.S. Pat. No. 4,113,544. The labeler 20 has a hand-held housing 21 formed integrally with a handle 22. A manually graspable operating lever 23 is pivotally mounted on the housing 21 about a pivot 24. The print head 25 is secured to the lever 23. The print head 25 can cooperate with a flat platen 26 at a printing position to print on a label L. The print head 25 is shown diagrammatically in greater detail in FIGS. 6 and 7. An embodiment of a composite label web C has been wound into a roll R supported by the labeler 20. The composite label web C passes about a direction-changing roll 29 and passes over the platen 26. The composite label web C depicted for example in FIGS. 8 and 9 includes a series of labels L releasably adhered by pressure sensitive adhesive A to carrier web W coated with a release coating RC. A label L is registered at a printing zone between the print head 25 and the platen 26. With reference again to FIG. 1, the carrier web W passes through a sharp bend about a delaminator preferably in the form of a peel roller 28. From there the web W passes partly around a direction-changing roll 29' and then partially about a toothed feed wheel 30 having teeth 31. The teeth 31 engage in feed apertures F (FIG. 9) which may include pairs of longitudinally spaced feed apertures F which may comprise transverse slots, as shown. The feed apertures F are aligned with the ends of the labels. The labels L are preferably end-to-end and are preferably defined by cuts BC known in the art as butt cuts so that there is no label material removal or waste between adjacent labels L. The feed apertures F lie along the same transverse lines at the butt cuts BC. The teeth 31 progressively engage and disengage with the feed apertures F in the carrier web W as the feed wheel 30 rotates. The feed wheel 30 is driven by a pawl and ratchet mechanism diagrammatically shown by dotted line PR. When the user operates the lever 23, the print head 25 is moved into printing cooperation with the platen 26 and the intervening label L. During such movement the pawl and ratchet mechanism PR is readied. Upon release of the lever 23, a spring not shown moves the lever 23 apart from the handle 22 and the pawl and ratchet mechanism PR rotates the feed wheel 30 through a distance to advance the leading label which has just been printed one label length into label applying relationship beneath applicator 32. The applicator 32 can take the form of a roll and is used to press the just-printed label onto surface S. The print head 25 is inked by a suitable ink roller 33.

Figure 2:
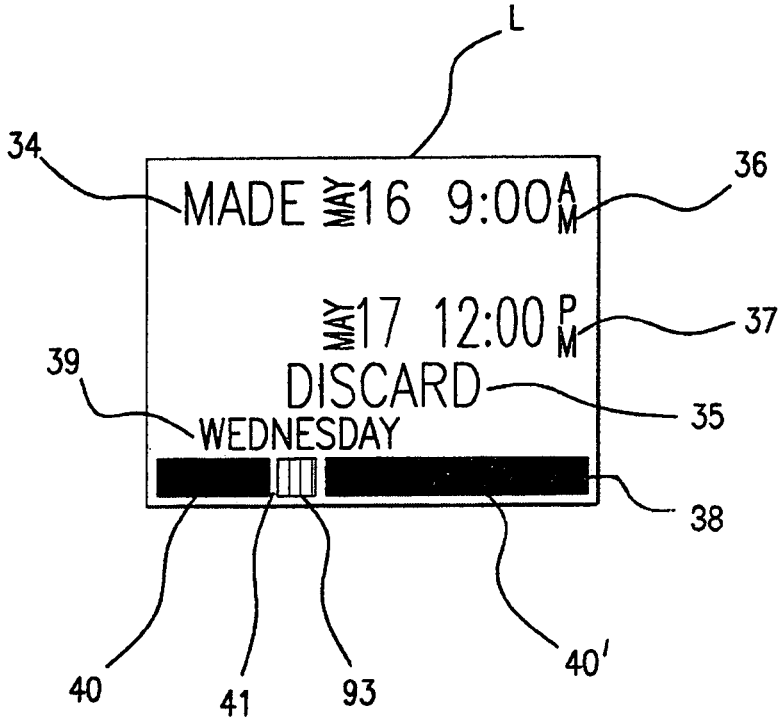
FIG. 2 is a top plan view of a printed label dispensed by the labeler of FIG. 1.

The label L dispensed by the labeler 20 is shown in greater detail in FIG. 2. The label L is illustrated to be generally rectangular and to be preprinted with the word "MADE" indicated at 34 and the word "DISCARD" indicated at 35. Any desired legends or words can be used and the words can be preprinted at different locations. The date and time when the perishable item was made or processed such as "May 16 9:00 AM" is indicated at 36, and the date and time when the perishable item is to be discarded if not used is May 17 12:00 PM" is indicated at 37, and an obliterating character indicated at 38, and the day of the week, namely "WEDNESDAY" indicated at 39, can all be printed by the inked print head 25. The print head 25 is shown to be a three-line print head. It is noted that the obliterating printed character 38 is divided into two portions 40 and 40' spaced by a non-printing portion. The void 41 between portions 40 and 40' leaves a pre-printed color-coded rectangular block or zone colored to visually indicate Wednesday as the discard date.

Figure 3:
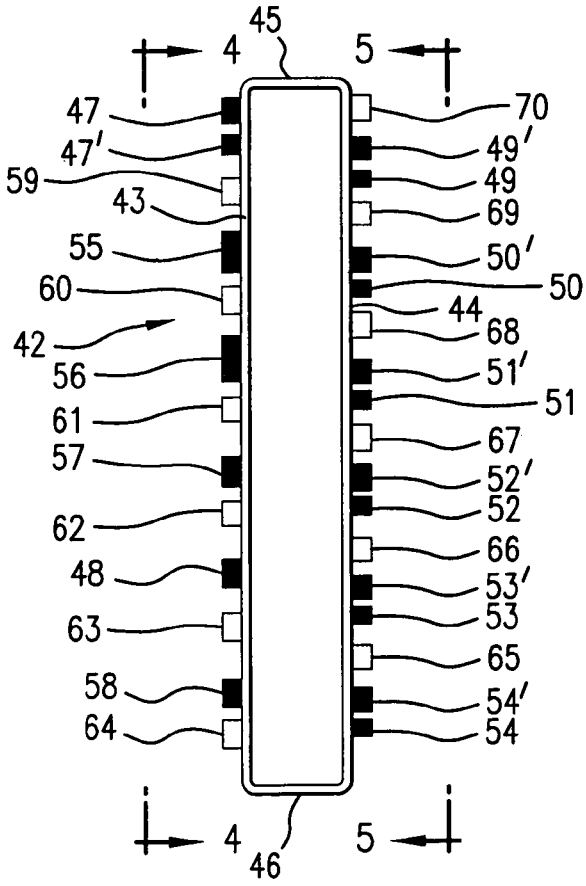
FIG. 3 is an end elevational view of a printing band used in the labeler of FIG. 1.
Figure 4:
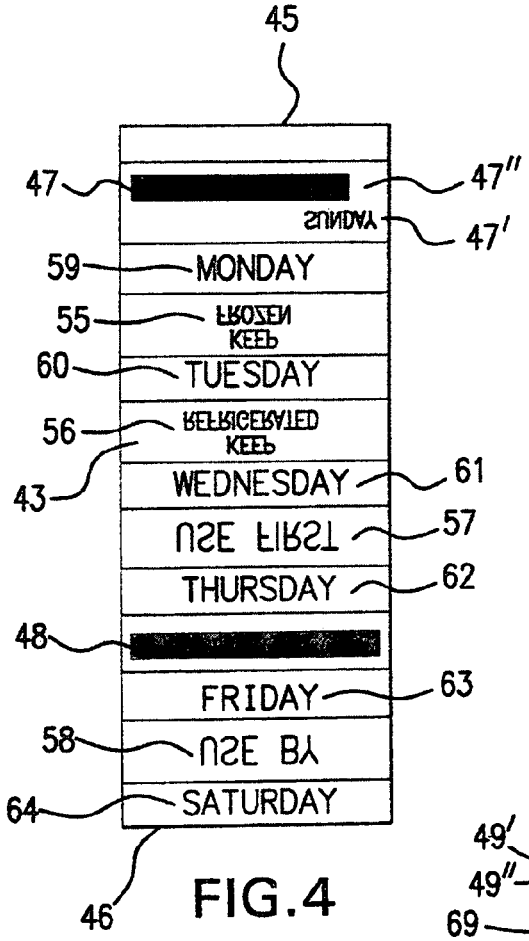
FIG. 4 is a view taken generally along line 4-4 of FIG. 3.
Figure 5:
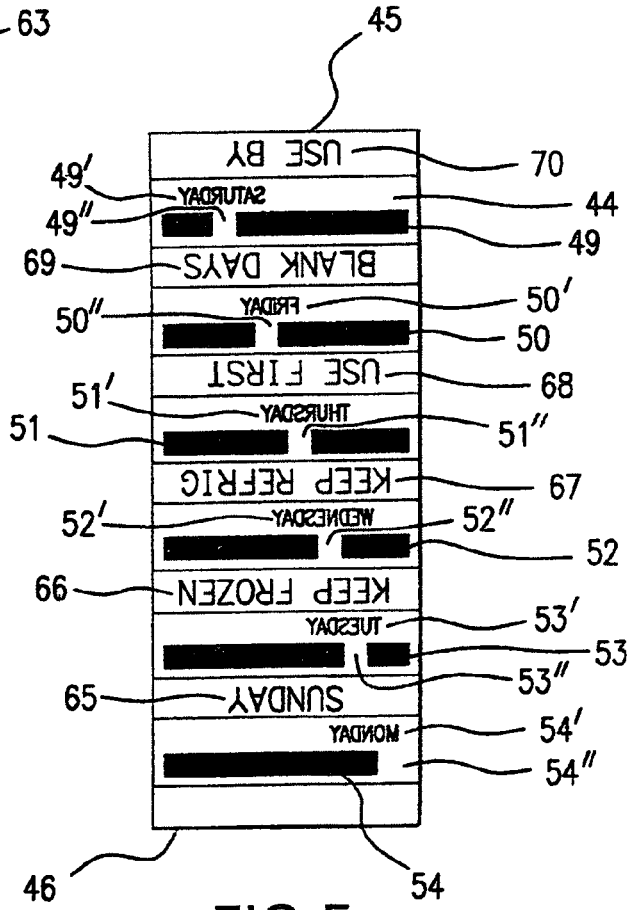
FIG. 5 is a view taken generally along line 5-5 of FIG. 3.

FIG. 3 shows an endless printing band 42 used in the print head 25. The printing band 42 has an outer surface with printing characters and non-printing human-readable characters disposed along the length of the printing band 42. FIGS. 3 through 5 show two sides 43 and 44 of the printing band as molded and it shows an embodiment of printing characters and non-printing human-readable characters. The ends 45 and 46 are blank of any printing or non-printing characters. As shown, the side 43 has obliterating printing characters 47 and 48 and day of the week printing character 47'. The side 44 has obliterating printing characters 49 through 54 and day of the week printing characters 49' through 54'. Accordingly, there is provided a set of seven obliterating printing characters 47 and 49 through 54 and a set of seven day of the week characters 47' and 49' through 54' and an eighth obliterating print character 48. In the seven lines in which the seven obliterating characters 47 and 49 through 54 occur, there is also one void or non-printing zone 47" and 49" through 54" and an eighth obliterating print character 48 which obliterates all seven color coded zones. It is noted that all the non-printing zones 47" and 49" through 54" are offset laterally from each other. The day of the week printing characters 47' and 49' through 54' are immediately adjacent respective obliterating printing characters 47 and 49 through 54.

The side 43 also has printing characters 55 such as "KEEP FROZEN" in reverse, printing character 56 such as "KEEP REFRIGERATED" in reverse, printing characters 57 such as "USE FIRST" in reverse, and printing characters 58 such as "USE BY" in reverse. The side 43 also has human-readable characters namely "MONDAY" 59, "TUESDAY" 60, "WEDNESDAY" 61, "THURSDAY" 62, "FRIDAY" 63, and "SATURDAY" 64. The side 44 also has human-readable characters, namely, "SUNDAY" 65, "KEEP FROZEN" 66, "KEEP REFRIG" 67, "USE FIRST" 68, "BLANK DAYS" 69, and "USE BY" 70. The human-readable characters of the printing band are diametrically opposite the corresponding printing obliterating and printing characters. As shown, the printing characters are shown in solid shading and the human-readable characters are shown in outline in FIG. 3.

Figure 6:
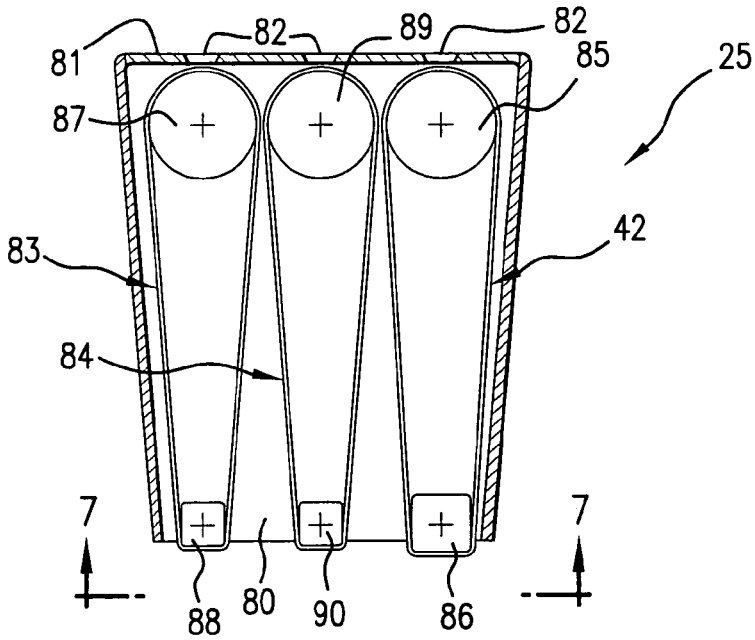
FIG. 6 is an end elevational view of the print head of the labeler shown in FIG. 1 with an end plate removed and showing a printing band as depicted in FIGS. 3 through 5.

With reference to FIG. 6, there is shown the print head 25 including spaced side plates 80 and a top portions 81 between the side plates 80. The top portion has three windows 82 through which the human-readable portions of the band 42 and bands 83 and 84 can be observed. The printing band 42 being flexible and resilient passes about round wheel 85 and square wheel 86. The printing band 42 and the two wheels 85 and 86 span all or most of the distance between the side plates 80. Each printing character which includes both characters 47 and 47', 49 and 49', 50 and 50', 51 and 51', 52 and 52', 53 and 53' and 54 and 54' can occupy a print position beneath the wheel 68, as viewed in FIG. 6. Each of these printing characters of the band 42 occupies an entire line as is best illustrated by reference to FIG. 7. The other two lines of printing bands are comprised of a number of flexible and resilient printing bands 83 and 84. Each printing band 83 and 84 is trained about a separate pair of wheels 87 and 88, and 89 and 90, respectively. Thus, the printing bands 83 comprise one line and the printing bands 84 comprise another line. Thus, the printing bands 42, 83 and 84 comprise three lines which are parallel to each other. The wheels 85, 87 and 89 can be selectively rotated by respective selector shafts 42', 83' and 84' to dial in the selected printing characters.

With reference to FIG. 8, there is shown the composite label web C with the label L on the left (also referred to as the "leading label") at the printing position or zone and the label L on the right being immediately upstream of the printing zone. As shown, the label L on the right, as with the other labels in the composite label web C, has seven printed zones or areas 91 through 97 disposed in a transverse or lateral line across the longitudinally extending web C. Each zone 91 through 97 has a color different from the colors in the other zones, preferably according to a convention that exists in the United States as stated above. Alternatively, colors according to other conventions can be used. Each zone 91 through 97 is cross-hatched differently to indicate a different color. The pre-printed legends 34 and 35 also appear on the labels L.

The label L which has been advanced to the printing zone can be overprinted by the user. As illustrated in FIG. 8, the print-head printed date and time when the perishable item was prepared have been printed by the bands 83 on the leading label L adjacent the word "MADE". The print-head printed date and time when the perishable item needs to be discarded have been printed by the bands 84 on the leading label L adjacent the word "DISCARD". The word "MONDAY" at 49' and the obliterating printing character 49 are printed simultaneously by the band 42. The obliterating printing character 49 obliterates all the zones 92 through 97, but not the zone 91. Thus the color corresponding to Monday is visually apparent on the overprinted leading label L.

FIG. 10 discloses the identical composite label web C with the labels L; pre-printed as in FIG. 8, except the printing bands 42, 83 and 84 have been selectively changed to reflect different dates and a discard day of Tuesday. All the pre-printed zones 91 and 93 through 97 have been obliterated by overprinting, except for the zone 92.

FIG. 11 discloses the identical composite label web C with the labels L pre-printed as in FIG. 8, except the printing bands 42, 83 and 84 have been selectively changed to reflect different dates and a discard day of Wednesday. All the pre-printed zones 91, 92, 94 through 97 have been obliterated by overprinting, except for zone 93.

FIG. 12 discloses the identical composite label web C with the labels L pre-printed as in FIG. 8, except the printing bands 42, 83 and 84 have been selectively changed to reflect different dates and a discard day of Thursday. All the pre-printed zones 91 through 93 and 95 through 97 have been obliterated by overprinting, except for zone 94.

FIG. 13 discloses the identical composite label web C with the labels L pre-printed as in FIG. 8, except the printing bands 42, 83 and 84 have been selectively changed to reflect different dates and a discard day of Friday. All the pre-printed zone 91 through 94, 96 and 97 have been obliterated by overprinting except for zone 95.

FIG. 14 discloses the identical composite label web C with the labels L pre-printed as in FIG. 8, except the printing bands 42, 83 and 84 have been selectively changed to reflect different dates and a discard day of Saturday. All the pre-printed zones 91 and 95 and 97 have been obliterated by overprinting, except for zone 96.

FIG. 15 discloses the identical composite label web C with the labels L pre-printed as in FIG. 8 except that certain printing bands 42, 83 and 84 have been selectively changed to reflect different dates and a discard day of Tuesday. All the pre-printed zones 91 through 96 have been obliterated by overprinting, except for zone 97.

FIG. 16 discloses the identical composite label web C with the labels L pre-printed as in FIG. 8, except that printing band 42 has been selectively changed so that obliterating printing character 48 obliterates all the pre-printed zones 91 through 97 by overprinting. The bands 83 and 84 can be set to print any selected characters on the leading label L, or information can be handwritten in the blank space.

Figure 7:
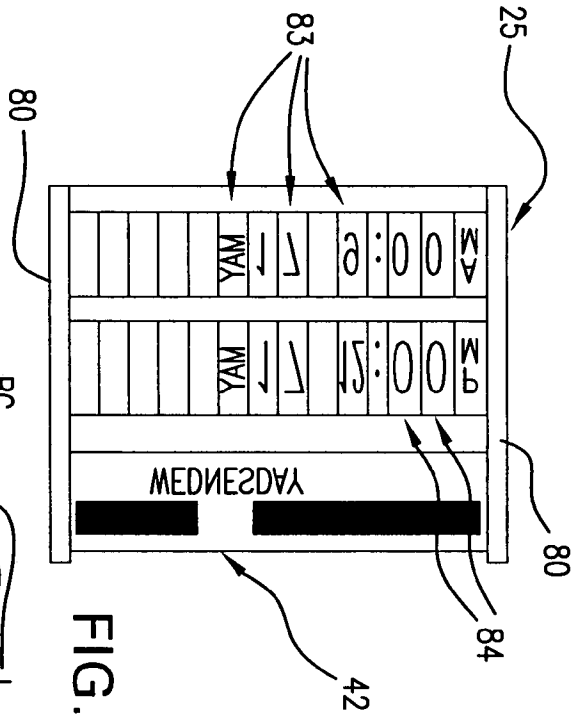
FIG. 7 is a bottom view taken along line 7-7 of FIG. 6.

Various types of labelers and print heads can be used alternative to the labeler depicted diagrammatically in FIG. 1 and the print head depicted in FIGS. 1, 6 and 7.

The print head 42 can have less than three lines of printing bands, for example, if it is desired to have a one-line print head, then the word band 42 can be used to obliterate colored zones. The printing band 42 can alternatively have other and different printing characters 55, 56, 57 and 58 to provide different word messages.

The color scheme for the colored zones 91 through 97 can be different from the colors illustrated. While the zones 91 through 97 are shown to be rectangular, they can have other shapes such as round or oval.

Other embodiments and modifications of the invention will suggest themselves to those skilled in the art, and all such of these as come within the spirit of this invention are included within its scope as best defined by the appended claims.

We claim:

1. An endless printing band capable of printing in seven aligned and laterally disposed zones across a label which is carried on a longitudinally extending carrier web, the printing band having an outer side with a set of at least seven different printing characters disposed at longitudinally spaced locations along the outer side, the printing band being flexible and selectively positionable to register a selected printing character at a printing zone, seven of the printing characters of the set having at least one printing portion and a non-printing portion, the non-printing portion of any one printing character being aligned and offset laterally with respect to all of the other non-printing portions of the set, and the printing portion(s) of each of the seven printing characters being located in a pattern to print in six and only six of the zones on the label wherein the non-printing portion of each printing character is configured to leave unprinted a different zone on the label.

2. An endless printing band as defined in claim 1, wherein the set includes seven printing characters with non-printing portions.

3. An endless printing band as defined in claim 1, wherein the set includes at least eight printing characters.

4. And endless printing band as defined in claim 1, and a print head including the printing band.

5. An endless printing band as defined in claim 1, a hand-held labeler capable of printing and dispensing labels, the labeler including a print head, a platen in which the print head cooperates at a printing zone, the labeler supporting a roll of labels releasably adhered to a carrier web, each label having a set of seven printed zones representative of seven days of the week, and each zone of each label being visually distinguishable by color from the other six zones, the printing band being a part of the print head, the printing band being positionable so that its selected non-printing portion is registered with the zone having a color corresponding to the selected day of the week.

6. The combination defined in claim 5, wherein the set includes seven printing characters with non-printing portions.

7. The combination defined in claim 5, wherein the set includes at least eight printing characters.

8. The combination defined in claim 7, wherein one of the eight printing characters can print at all seven zones of the label.

9. The combination defined in claim 5, wherein at least some of the printing characters print at spaced locations along a straight line.

10. The combination defined in claim 9, wherein the color-distinguishable zones on the label are arranged along a straight line.

11. The combination defined in claim 5, wherein the color-distinguishable zones on the label are arranged along a straight line.

* * * * *